US005120204A

United States Patent [19]

Mathewson et al.

[11] Patent Number: 5,120,204

[45] Date of Patent: Jun. 9, 1992

[54] HELICAL GEAR PUMP WITH PROGRESSIVE INTERFERENCE BETWEEN ROTOR AND STATOR

[75] Inventors: Lindsay T. Mathewson, Buxton; Geoffrey H. May, Rochdale, both of England

[73] Assignee: Mono Pumps Limited, Audenshaw, England

[21] Appl. No.: 746,174

[22] Filed: Aug. 15, 1991

Related U.S. Application Data

[63] Continuation of Ser. No. 472,571, Jan. 30, 1990, abandoned.

[30] Foreign Application Priority Data

Feb. 1, 1989 [GB] United Kingdom ..... 8902230.5

[51] Int. Cl.[5] ..... F04C 2/107; F04C 5/00

[52] U.S. Cl. ..... 418/48; 418/178

[58] Field of Search ..... 418/48, 178

[56] References Cited

U.S. PATENT DOCUMENTS

| | | | |
|---|---|---|---|
| 3,380,391 | 4/1968 | John | 418/48 |
| 4,104,009 | 8/1978 | Chanton | 418/48 |
| 4,676,725 | 6/1987 | Eppink | 418/48 |
| 4,773,834 | 9/1988 | Saruwatari | 418/48 |
| 4,863,359 | 9/1989 | Unterstrasser et al. | 418/48 |

FOREIGN PATENT DOCUMENTS

| | | |
|---|---|---|
| 1553148 | 7/1969 | Fed. Rep. of Germany . |
| 1553146 | 2/1970 | Fed. Rep. of Germany . |
| 2017620 | 4/1976 | Fed. Rep. of Germany . |
| 1542786 | 3/1979 | United Kingdom . |

*Primary Examiner*—John J. Vrablik

*Attorney, Agent, or Firm*—Fleit, Jacobson, Cohn, Price, Holman & Stern

[57] ABSTRACT

A helical gear pump is described in which the geometry of the stator and rotor are modified such that the interference is significantly more at the locations of the minor diameter d than the locations of the major diameter D of the rotor. The rotor is preferably plasma coated with modified chromium oxide and the base metal of the rotor is advantageously machined so that in the region of locations of major diameter D, the thickness of the plasma coating is less and, in the region of the locations of minor diameter d, the thickness of the plasma coating is greater than in the remainder of the rotor while allowing the interference to be significantly more at the locations of the minor diameter d than at the locations of the major diameter D.

5 Claims, 2 Drawing Sheets

HELICAL GEAR PUMP WITH PROGRESSIVE INTERFERENCE BETWEEN ROTOR AND STATOR

This application is a continuation of application Ser. No. 07/472,571, filed Jan. 30, 1990, now abandoned.

The present invention relates to helical gear pumps. These comprise an outer stator member with a helical female gear formation of n starts, an inner rotor rotatable within said stator having a helical male gear formation of the same lead of n±1 starts, means being provided to cause the rotor to rotate and orbit relative to the stator.

Usually the rotor has n−1 starts.

Traditionally the outer stator member is formed of a resilient, rubber like material and the rotor is formed of metal, usually steel. A typical example is shown in U.S. Pat. No. 4,773,834. For the pump to operate satisfactorily, there must be a good seal at all times formed between the rotor and the stator so that the cavities formed therein, which progress through the pump, are effectively sealed between suction and discharge pressure. The seal is improved if the interference between the rotor and stator is increased, but this causes problems of requiring a greater drive power, heat generation and of wear on the two parts, particularly the stator.

The helical gear formation of the rotor is such as to provide peaks and troughs in the rotor and experience has shown that wear on the rotor is normally initiated close to the rotor major diameter or peak. In order to reduce the amount of wear, it has been proposed to use a coating on the rotor of chromium oxide, this being applied by plasma coating. The use of chromium oxide as a coating medium results in a thicker deposition of the chromium oxide at the minor diameter or trough i.e. where it is least required. This is due to the complexity of the rotor geometry associated with the coating process which involves rotating the rotor about its normal axis, while applying the chromium oxide coating by means of a gun which traverses the length of the rotor parallel to the axis of rotation. As the rotor is rotated, the peripheral speed at the peaks will be higher than at the troughs. Furthermore, as the plasma torch or gun traverses along the length of the rotor, the distance or "gun gap" g between the gun and the rotor varies between g and g+2e, where e is the eccentricity of the rotor.

The combination of varying peripheral speed and varying "gun gap" g lead to an uneven distribution of the coating. Consequently, it has been found that with a conventional rotor, in which the ratio d/e=5 and P/e=12.5, (where d is the minor diameter, e is the eccentricity and P is the rotor pitch), the coating thickness ratio between the minor diameter and the major diameter (the trough and the peak) has been found to be in excess of 1.5:1. This has two disadvantages. Firstly there is an unnecessary coating of the rotor at the minor diameter and secondly there is a risk of overcoating at the minor diameter, bearing in mind chromium oxide has a maximum thickness after which it peels off, that is its integrity of coating is reduced.

It is now proposed, according to the present invention, to provide a helical gear pump comprising an outer stator member with a helical female gear formation of two starts, an inner rotor rotatable within said stator and having a helical male gear formation of the same lead of one start, and means to cause said rotor to rotate and orbit relative to said stator, the rotor having a major diameter D, a minor diameter d, a pitch P and an eccentricity e, the shape of the helical female gear formation of the stator consisting of two semi-circular cross section-portions joined by two straight line portions, wherein the interference between the rotor and the stator is arranged to be such that the interference is significantly more at the locations of the minor diameter d than at the locations of the major diameter D, and wherein interference with the rotor diminishes progressively between the straight line and the semi-circular cross-section portions of the helical female gear formation of the stator.

It has been found that if there is too much interference at the major diameter the capacity of the pump is reduced, largely because the size of the cavities formed between the rotor and stator is reduced by the larger diameter rotor. Equally important, however, if there is too much interference at the ma]or diameter the power requirement is increased. The provision of a greater interference at the minor diameter has less effect in both of these connections and ensures that a good seal is produced thereby improving the efficiency of the pump.

In the prior known constructions the shape of the cross-section of the helical female formation of the stator are formed by parts which are slightly greater than the semi-circles and by two paris of straight lines which taper slightly inwardly. The constructions are such that a sharp change in interference occurs where the straight lines meet the part circular portions, which adds to the problems indicated above. These problems are overcome by the structure of the invention.

In a preferred construction, the interference at the location of the minor diameter d is considerably greater than the interference at the locations of the major diameter and the ratio d/e of the minor diameter d to eccentricity e is at least 8.

Advantageously the ratio P/e of the rotor pitch P to the eccentricity e is at least 17.5.

As indicated earlier, improved results can be achieved in pumps of this type if the metal of the rotor is plasma coated with a coating of chromium oxide. Advantageously with the structure of the present invention, the base metal of the rotor, prior to plasma coating, is machined so that in the region of the location of major diameter D, the thickness of the plasma coating is less and in the region of the locations of minor diameter d, the thickness of the plasma coating is greater than in the remainder of the rotor, while allowing the interference to be significantly more at the locations of the minor diameter d than at the locations of the major diameter D.

In order that the present invention may be more readily understood, the following description is given, merely by way of example reference being made to the accompany drawing in which.

Figure 4:
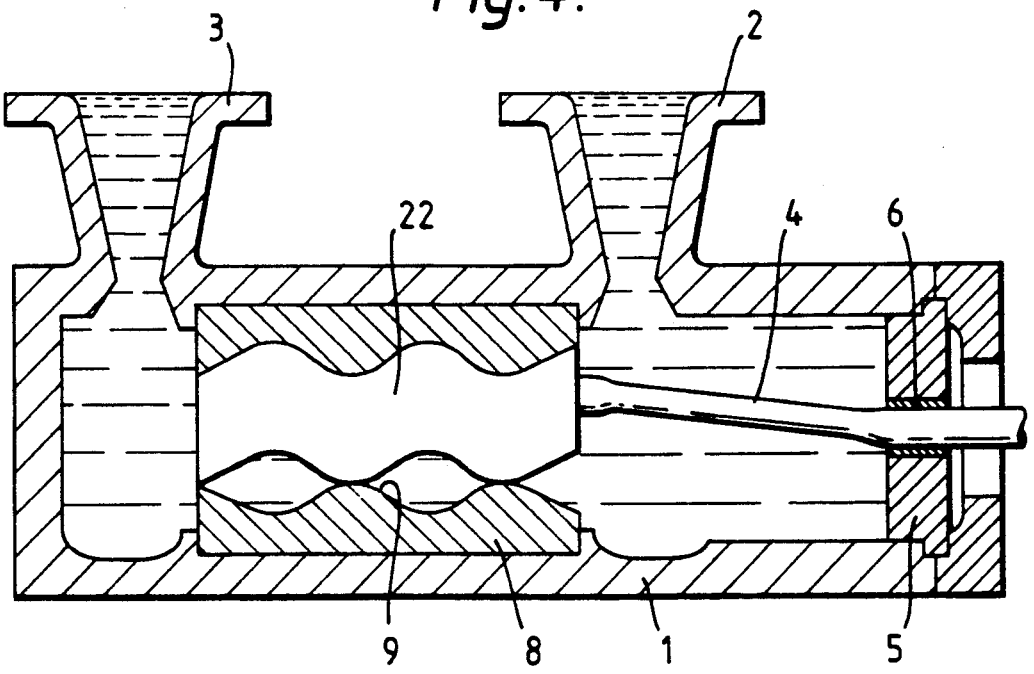
FIG. 4 is a cross-section through the pump.

The pump illustrated in FIG. 4 includes a casing 1 having an inlet 2 and an outlet 3. A drive shaft 4, which may be of the conventional rigid or flexible type, passes through a bulkhead 5 via a bearing and/or seal assembly 6. A stator 8 is secured in the casing 1 and includes a two start female helical gear formation 9. A rotor 22 having a one start male helical gear formation 11 is driven by a motor (not shown) and drive shaft 4 to rotate and orbit in the stator 8.

Figure 1A:
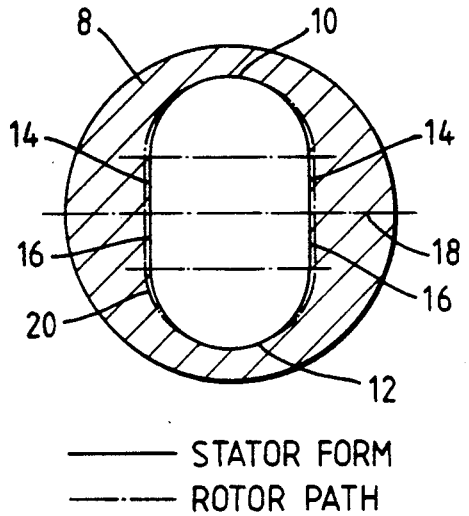
FIG. 1A is a cross sectional schematic view showing the stator form and rotor path of one embodiment of helical gear pump according to the invention.
Figure 1B:
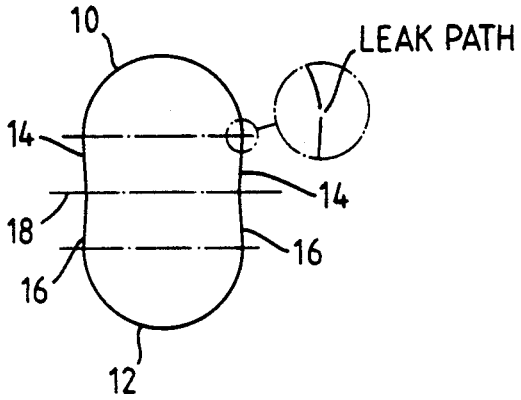
Fig. 1B. (PRIOR ART)
FIG. 1B is a similar view of a conventional pump.

Referring now to FIG. 1A and 1B, the stator 8 is shown schematically, with the female helical gear form shown in full lines and the path of the rotor shown in dotted lines. In the conventional structure of FIG. 1B, the rotor path is substantially coterminous with the stator form shown in full line. The stator form consists of two substantial semi-circular zones 10,12 and, on each side, two sets of straight line portions 14,14,16,16, the sets 14,16 meeting at the horizontal centre line 18 of the stator form. At the junction of the semi circular portions 10,12 with the straight line portions 14,16, there is a sharp change in interference and experience has shown that there tends to be a leak path as is shown in the enlarged encircled portion in FIG. 1B.

With the structure according to the present invention, the stator form is modified slightly so that the portions 14,16 essentially form a straight line. Also the dimensions of the rotor are chosen so that there is a significant interference as can be seen by the fact that the chain dotted indication of the rotor path 20 is shown, at least along the straight line portions 14,16, and a significant part of the semi-circular portions 10,12 of the stator forms, to be outside the stator form. The interference therefore diminishes progressively and smoothly from the straight line to the semi-circular portion.

On the other hand, however, the interference at the locations of the major diameter are not significantly changed so that the interference at the locations at the minor diameter is significantly greater than the interference at the locations of the major diameter.

Figure 2:
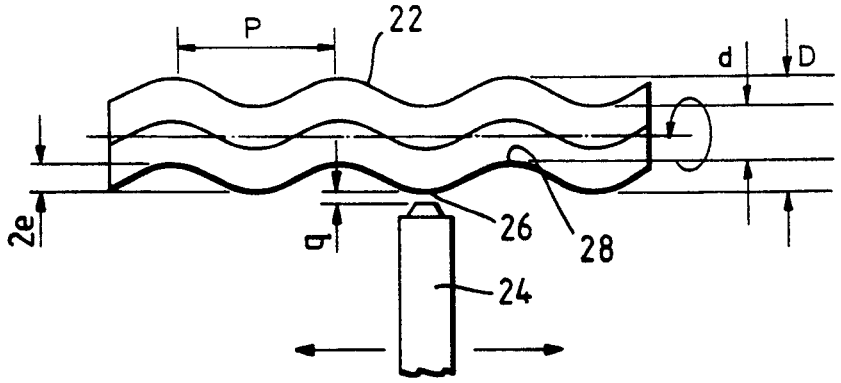
FIG. 2 is a schematic side elevation showing the coating of a rotor according to the invention.

If reference is now made to FIG. 2 of the drawings it will be seen that the rotor 22 is shown as being sprayed with a coating, such as chromium oxide, by a plasma gun 24. At the vicinities of the peaks of 26 of the rotor the gap of the rotor from the plasma gun is shown as a distance g. It will be appreciated that the gap at the troughs 28 of the rotor will be $g+2e$. This tends to produce a greater thickness of coating at the troughs 28 than at the peaks 26. Therefore the base metal of the rotor is machined, with a construction according to the invention, so that in the region of the locations of major diameter, that is at the peaks 26, the thickness of the plasma coating is less and in the region of the locations of minor diameter, that is in the troughs, the thickness of the plasma coating is greater than in the remainder of the rotor, while allowing the interference to be significantly more at the locations of the minor diameter than at the locations of the major diameter.

In this way optimum coating can be achieved without there being any fear of the integrity of the coating with the base metal being broken down and yet the desired interference which is greater at the locations of minor diameter than at the locations of the major diameter can also be arrived at.

In a preferred arrangement, the ratio d/e of the minor diameter d to the eccentricity e is at least 8 and the ratio P/e of the pitch P to the eccentricity e is at least 17.5.

Figure 3:
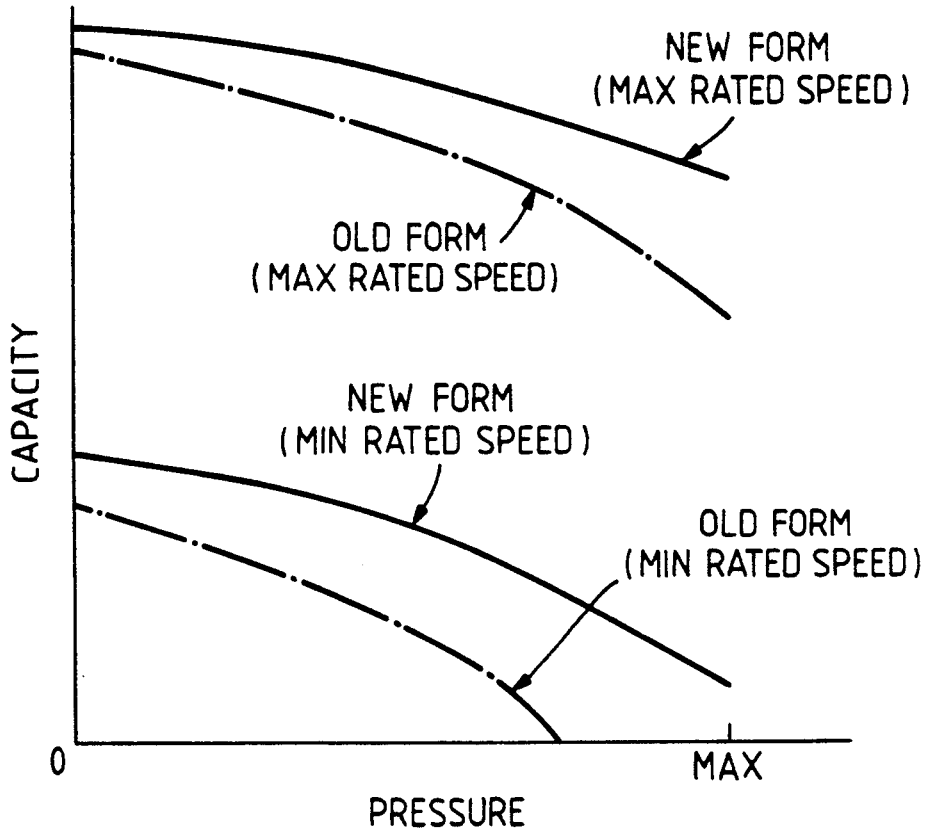
FIG. 3 is a graph showing the relationship between capacity and pressure of the convention pump and a pump according to the present invention.

If one now looks at FIG. 3, one will see that the pressure/capacity curve of the pump according to the invention is shown in full line and the corresponding curve for a conventional pump of the same rating is shown in chained dotted lines. It will be seen that firstly there is a greater capacity at all times for the same pressure throughout the whole range of pressure both at the minimum rated speed of the pump and at the maximum rated speed and that there is a lesser drop off in the capacity as the pressure increases from minimum to maximum throughout the speed range of the pump. As can be seen from the comparison of the stator forms, the new form has eliminated the leak paths and this improves the performance of the rotor/stator combination and also prevents abrasive particles becoming trapped in the seal line where they potentially can cause more damage to the rotor.

Wear tests with chromium oxide coated rotors having d/e ratio of 8 and P/e ratio of 17.5 have been extensively tested alongside hard chrome plated rotors having a more orthodox geometry. These wear tests have shown a significant increase in life in favour of chromium oxide coated rotors.

With a conventional rotor geometry, i.e. $d/e=5$ and $P/e=12.5$, the coating thickness ratio of the minor:major (trough:peak) has been found to be in excess of 1.5:1. The geometry has according to the invention, in which $d/e=8$ and $P/e=17.5$ substantially reduces this ratio to 1.3:1 this results in the two advantages that it reduces the unnecessary coating at the minor diameter and reduces the risk of over coating at the major diameter which would result in the coating peeling off.

We claim:

1. A helical gear pump comprising a female helical stator form of two starts and a male rotor form of one start, the stator and rotor forms having identical leads, the stator form comprising two substantially part circular end portions separated by two substantially straight lien portions, the female stator form defining a major diameter and a minor diameter, intersecting at a centre of the stator form, the male rotor being of a substantially helical construction, defining an axis, the axis orbiting in sue about the centre of the stator form, at a given radius in a first sense, while, in use the rotor rotates about the axis in the opposite sense, first locations on the rotor surface closest to the rotor axis defining a minor diameter of the rotor between said first location and the axis, and second locations on the rotor surface furthest from the rotor axis defining a major diameter between said second location and the axis, interference between the rotor and the stator being defined by the overlay between the volume swept by the rotor and the stator form, the overlay being determined by the major and minor diameter of the stator, the radius of orbit of the rotor axis about the stator centre, and the distance of an interfering location on the rotor from the rotor axis, the improvement comprising the distance from the rotor axis to said first locations being increased so as to cause greater interference on the rotor at said first locations than at said second locations, whereby interference is greater at locations on the rotor closer to the rotor axis than at locations further from it, the interference diminishing progressively between the minor and major diameter location of the rotor.

2. A pump according to claim 1, wherein the ratio d/e of the minor diameter d defined by the minimum distance from the axis of the rotor to its surface of the rotor to eccentricity e of the rotor is at least 8.

3. A pump according to claim 1, wherein the ratio P/e of the pitch P of the rotor to the eccentricity e of the rotor is at least 17.5.

4. A pump according to claim 1, wherein the rotor is of metal, and is plasma coated with a coating of chromium oxide.

5. A pump according to claim 4, wherein the base metal of the rotor, in those locations furthest from the rotor axis support a thickness of the plasma coating that is less thick than in the remainder of the rotor and in those locations closer to the rotor axis supports a thickness of the plasma coating that is greater than in the remainder of the rotor, while allowing the interference to be significantly more at locations closer to the rotor axis than locations furthest from the rotor axis.

* * * * *